US009464804B2

(12) United States Patent
Tremblay et al.

(10) Patent No.: US 9,464,804 B2
(45) Date of Patent: Oct. 11, 2016

(54) GAS FLARE SYSTEM AND METHOD OF DESTROYING A FLAMMABLE GAS IN A WASTE GAS STREAM

(71) Applicant: RTJ TECHNOLOGIES INC., Montreal (CA)

(72) Inventors: Charles Tremblay, Montreal (CA); Alain Roy, Montreal (CA); Simon Jasmin, Montreal (CA)

(73) Assignee: RTJ TECHNOLOGIES INC., Montreal, Quebec (CA)

( * ) Notice: Subject to any disclaimer, the term of this patent is extended or adjusted under 35 U.S.C. 154(b) by 500 days.

(21) Appl. No.: 14/083,946

(22) Filed: Nov. 19, 2013

(65) Prior Publication Data

US 2014/0147795 A1 May 29, 2014

Related U.S. Application Data

(60) Provisional application No. 61/729,509, filed on Nov. 23, 2012.

(30) Foreign Application Priority Data

Feb. 22, 2013 (CA) ..... 2808707

(51) Int. Cl.
*F23G 7/08* (2006.01)

(52) U.S. Cl.
CPC ..... *F23G 7/085* (2013.01)

(58) Field of Classification Search
CPC ..... F23G 7/08; F23G 7/085; F23G 5/50; F23G 2207/30; F23N 1/025; F23N 2025/10; F23N 2037/16; F23N 2041/12
USPC ..... 431/5, 10, 12, 202
See application file for complete search history.

(56) References Cited

U.S. PATENT DOCUMENTS

| | | | |
|---|---|---|---|
| 715,968 | A | 12/1902 | Britton |
| 811,764 | A | 2/1906 | Colegrove et al. |
| 1,542,740 | A | 6/1925 | Spillman |
| 2,439,353 | A | 4/1948 | Wiseman |
| 3,384,001 | A | 5/1968 | Mathis |
| 3,893,810 | A | 7/1975 | Lientz |
| 3,982,881 | A | 9/1976 | Schwartz et al. |
| 4,004,875 | A | 1/1977 | Zink et al. |

(Continued)

FOREIGN PATENT DOCUMENTS

| | | | |
|---|---|---|---|
| GB | 2348482 | A | 10/2000 |
| WO | 2006082169 | A1 | 8/2006 |

*Primary Examiner* — Jorge Pereiro
(74) *Attorney, Agent, or Firm* — IPAXIO S.E.N.C.

(57) ABSTRACT

The gas flare system includes a vertical flare stack having an opened top end and a bottom floor wall. A weatherproof protective hood arrangement prevents rain and snow from entering through the opened top end. The gas flare system also includes a burner arrangement provided through the bottom floor wall. The burner arrangement receives a waste gas stream from a waste gas circuit and also primary air. Secondary air orifices around the burner supply secondary air coming from a plenum housing located directly underneath the bottom floor wall. The gas flare system can destroy the flammable gas in the waste gas stream with a combustion efficiency of more than 99% under almost any operating conditions. It can start automatically and operate efficiently without any supervision under any possible atmospheric conditions. A method of destroying a flammable gas in a waste gas stream is also disclosed.

21 Claims, 6 Drawing Sheets

(56) References Cited

U.S. PATENT DOCUMENTS

| | | | |
|---|---|---|---|
| 4,610,625 | A | 9/1986 | Bunn |
| 4,629,413 | A | 12/1986 | Michelson et al. |
| 4,892,477 | A | 1/1990 | Zimmiond |
| 5,062,788 | A | 11/1991 | Best |
| 5,224,852 | A | 7/1993 | Eden |
| 5,531,973 | A | 7/1996 | Sarv |
| 5,681,159 | A | 10/1997 | Benedek et al. |
| 6,231,334 | B1 | 5/2001 | Bussman et al. |
| 6,632,083 | B1 | 10/2003 | Bussman et al. |
| 6,634,881 | B2 | 10/2003 | Bussman et al. |
| 8,282,389 | B2 | 10/2012 | Dhulst et al. |
| 2003/0013059 | A1 | 1/2003 | Dutescu et al. |
| 2005/0074712 | A1 | 4/2005 | Brookshire et al. |
| 2008/0081304 | A1 | 4/2008 | Poe et al. |

GAS FLARE SYSTEM AND METHOD OF DESTROYING A FLAMMABLE GAS IN A WASTE GAS STREAM

RELATED APPLICATIONS

The present case claims priority to U.S. Patent Application No. 61/729,509 filed 23 Nov. 2012 and to Canadian Patent Application No. 2,808,707 filed 22 Feb. 2013, the entire contents of which are incorporated herein by reference in their entirety.

TECHNICAL FIELD

The technical field relates generally to gas flare systems for destroying flammable gases in waste gas streams. It also relates generally to methods of destroying flammable gases in waste gas streams.

BACKGROUND

Flammable gases are generally used as energy sources but some situations may require the use of gas flares for their destruction, for instance in the event of a production surplus or an unexpected shutdown of an equipment in which a flammable gas is normally burned to generate heat. Other situations exist. Some flammable gases are byproducts of natural or industrial processes where the flammable gas source cannot be stopped and/or be easily controlled, and that the flammable gases cannot be stored for a later use. Thus, in case of a surplus of flammable gases or an unexpected equipment shutdown in such context, a gas flare is an alternative to releasing the flammable gases directly into the atmosphere.

One example of a flammable gas source that cannot be stopped and/or be easily controlled is a landfill site. In a landfill site, organic matters contained in the waste slowly decay over time using a natural process and generate a gas stream containing methane gas ($CH_4$). Methane gas is a flammable gas and is mixed with other flammable and non-flammable gases in varying proportions when coming out of the landfill site. Methane gas is a valuable source of energy but is also a greenhouse gas if released directly into the atmosphere. Thus, if the methane gas contained in a gas stream coming out of a landfill site cannot be readily used or stored, it should be destroyed by combustion in a gas flare. Gas streams containing methane gas can also be created by other processes, for instance in an anaerobic digester. Many other situations and contexts exist.

A waste gas stream could also be a flammable gas or a mixture of flammable gases that is simply unusable for some reason and for which the destruction is required. This flammable gas or mixture can even represent 100% or close to 100% of the total waste gas content.

Waste-to-energy projects are systems designed for transforming at least a portion of the flammable gas or gases contained in gas streams into useful energy, for instance heat energy. They receive gas streams from sources such as landfill sites and anaerobic digesters, thus from sources that contain waste materials. For this reason, these gas sources can be referred to as waste gas sources and the gases flowing therefrom can be referred to as waste gas streams. Capturing waste gas streams offers significant environmental and economic benefits when used in a waste-to-energy project since the waste gas streams would otherwise be released into the atmosphere or be simply burned off in gas flares on a continuous basis.

Various factors may affect the proportion of methane gas fraction in waste gas streams coming, for instance, from a landfill site. The flow rate of the collected gases can also vary over time. In a waste-to-energy project constructed next to a landfill site, it may happen that the waste gas stream from the landfill site is generated in excess to what the waste-to-energy system can consume. Still, the waste-to-energy project can also be abruptly stopped in an unplanned manner. These are examples of situations where having a gas flare associated with a waste-to-energy project is required for suitably destroying the flammable gases in the waste gas stream. Many other situations exist as well.

One of the challenges in the design of gas flares, particularly in the context of waste-to-energy projects, is the unpredictability in the need of operating them and the usually long standby periods. Waste-to-energy projects can run continuously for months without the need of operating an associated gas flare. As a result, the gas flare can be difficult to restart after a prolonged standby period. Rain water and snow accumulations inside the flare stack can also prevent the gas flare from starting when needed. Other factors and complications exist, all of which can hinder the overall efficiency and operation of the gas flares over time. Existing gas flares are not well adapted to relatively long standby period, especially under inclement weather conditions like heavy rain or freezing temperatures, to name just a few. Extensive maintenance operations by on-site technicians can be required simply to restart gas flare.

Another challenge in the design of gas flares is that the destruction of methane gas or of other flammable gases present in waste gas streams using a gas flare is generally highly regulated. For example, the residence time of the flue gas in the combustion chamber and its temperature must often meet certain minimum values to insure that flammable gases have been destroyed in the gas flare with an efficiency of at least 98%. Minimizing the temperature during the destruction of the flammable gas is also often desirable so as to minimize nitrogen oxides (NOx) formations in the flare stack chamber at high temperatures. Having a low-NOx system decreases air pollution.

As the flammable gas fraction in a waste gas stream often varies over time, it may happen that the flammable gas fraction falls down to the point where the waste gas stream can no longer be used as a source of energy at the waste-to-energy project. In a waste gas stream coming from a landfill site, the methane gas fraction is generally about 25% to 65% in weight of the total waste gas stream. A very relatively small proportion of flammable gas will increase the difficulty of sustaining the flame and if the proportion is too low, no flame can be generated.

The flow rate of the waste gas stream itself can also vary anywhere from 0 to 100% of the gas flare capacity. Gas flares must be capable of handling up to the maximum flow rate of the waste gas stream that can be produced by the waste gas source. However, most gas flares have a relatively low turndown ratio, such as 3:1. The turndown ratio is the ratio between the maximum and minimum flow rates of the waste gas stream that can be processed by the gas flare. Having a low turndown ratio restricts the possibility of destroying the flammable gas through combustion when the flow rate is relatively small because the burner arrangement of the gas flare would be too large.

Accordingly, there is still room for many improvements in this area of technology.

SUMMARY

In one aspect, there is provided a gas flare system for destroying a flammable gas contained in a waste gas stream, the gas flare system including: a flare stack defining a flare stack chamber extending vertically between a bottom floor wall and an opened top end of the flare stack; a weatherproof protective hood arrangement including an overhead cap located vertically above the opened top end and covering more than an entire area of the opened top end, and a lateral peripheral shroud surrounding the opened top end and the overhead cap; a plenum housing located directly underneath the bottom floor wall; a burner arrangement provided through the bottom floor wall, the burner arrangement having at least one burner outlet including: a top-opened combustion chamber extending above the bottom floor wall; a primary air housing extending under the bottom floor wall and into the plenum housing; a waste gas outlet located at a bottom of the combustion chamber; and a primary air outlet extending between the primary air housing and the bottom of the combustion chamber, the primary air outlet being adjacent to the waste gas outlet; a waste gas circuit in fluid communication with the waste gas outlet of the at least one burner outlet; a primary pressurized air circuit in fluid communication with the primary air housing of the at least one burner outlet, the primary air circuit including a primary air circuit flow regulator; a primary air pressure sensor provided on the primary air circuit; a secondary pressurized air circuit in fluid communication with the flare stack chamber, the secondary air circuit passing inside the plenum housing and ending at a plurality of secondary air orifices provided through the bottom floor wall around the at least one burner outlet, the secondary air circuit including a secondary air circuit flow regulator; a waste gas composition analyzer in fluid communication with the waste gas inlet pipe; a waste gas pressure sensor provided on the waste gas inlet pipe; a waste gas flow meter provided on the waste gas inlet pipe; a flue gas composition analyzer in fluid communication with a location adjacent to the opened top end inside the flare stack chamber; a flue gas temperature sensor located in the flare stack chamber and adjacent to the opened top end; a first controller sending command signals to control at least the primary air circuit flow regulator in response to data signals received from at least the waste gas pressure sensor, the waste gas flow meter, the waste gas composition analyzer, the flue gas composition analyzer and the primary air pressure sensor; and a second controller sending command signals to control at least the secondary air circuit flow regulator in response to data signals received from at least the flue gas temperature sensor.

In another aspect, there is provided a method of destroying a flammable gas in flare system, the method including: continuously preventing rain water and snow from entering through an opened top end of the flare system; monitoring pressure, flow rate and flammable gas fraction of the waste gas stream received at the flare system; supplying the waste gas stream to a burner arrangement provided inside the flare system; and burning off the flammable gas by: supplying pressurized primary air inside the burner arrangement, the primary air and the waste gas stream only mixing inside a combustion chamber of the burner arrangement; supplying pressurized secondary air from underneath the burner arrangement; ejecting the secondary air around the a combustion chamber of the burner arrangement; monitoring temperature and flammable gas fraction of the flue gas resulting from burning off the flammable gas; controlling the primary air supplied to the burner arrangement at least in function of the flammable gas fraction in the waste gas stream, the waste gas stream pressure, the waste gas stream flow rate and the flammable gas fraction in the flue gas; and controlling the secondary air at least in function of the flue gas temperature.

Further details on these aspects as well as other aspects of the proposed concept will be apparent from the following detailed description and the appended figures.

DETAILED DESCRIPTION

Figure 1:
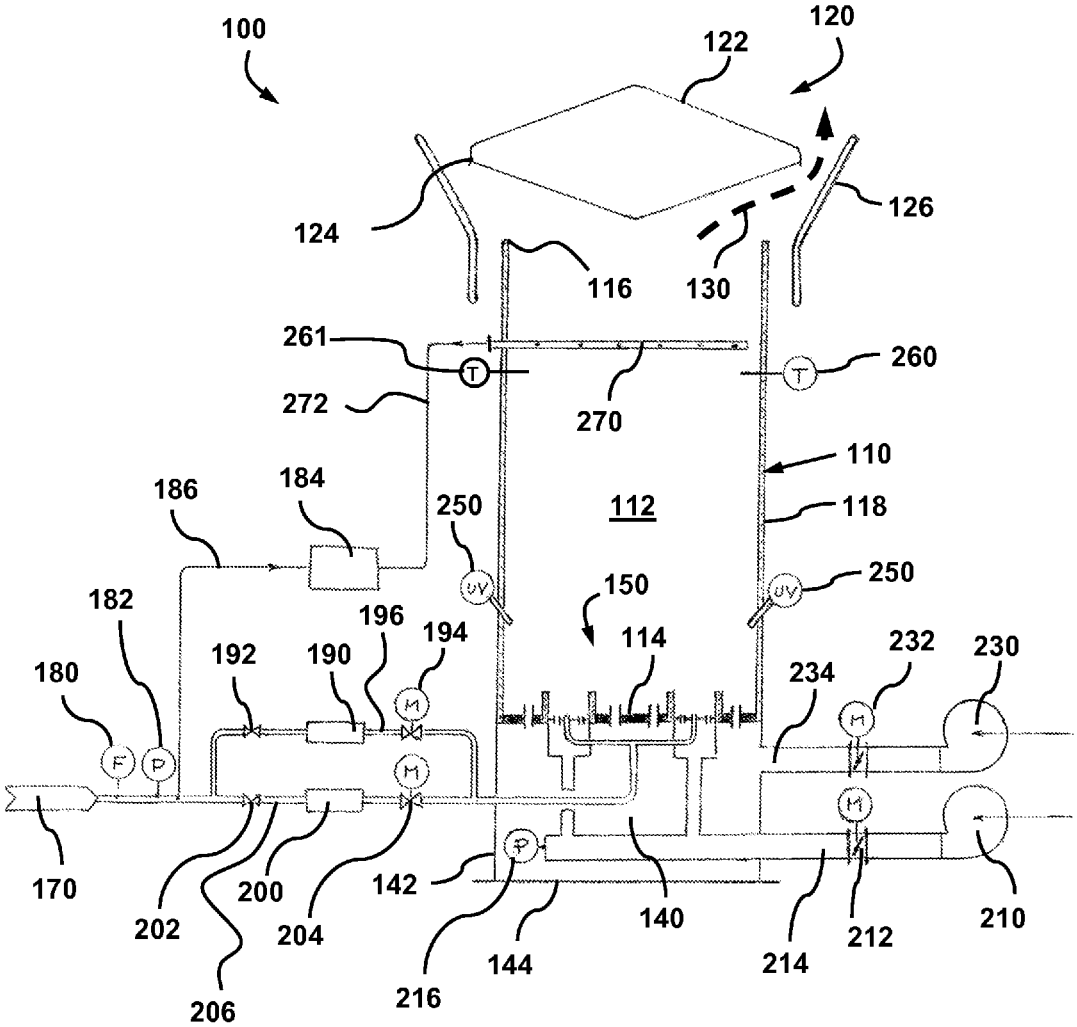
FIG. 1 is a semi-schematic cross-sectional view illustrating an example of a gas flare system incorporating the proposed concept.

FIG. 1 is a semi-schematic cross-sectional view illustrating an example of a gas flare system 100 incorporating the proposed concept. The gas flare system 100 is designed to destroy a flammable gas contained in a waste gas stream. The source of the waste gas stream can be, for instance, a landfill site and the flammable gas will then contain methane gas. Other flammable gases can also be present in the waste gas stream coming from a landfill site, for instance volatile organic compounds (VOC), all of which can be destroyed in the gas flare system 100.

It should be noted that the proposed concept is not limited to waste gas streams coming from landfill sites or the like. It is thus not limited to the destruction of methane gas since other sources of waste gas streams can contain one or more other flammable gases. Nevertheless, for the sake of clarity, reference will now be made to a single flammable gas, regardless of whether the flammable gas is a mix of two or more flammable gases or not. The expression "flammable gas" is thus used in a generic manner. The example described in the detailed description will also sometimes refer to the flammable gas as being methane gas. This is only one example of an implementation. Furthermore, the expression "in operation" as used in the context of the present detailed description refers to the gas flare system 100 when the flammable gas burns therein. The gas flare system 100 is otherwise almost always in a standby mode when not in operation.

The gas flare system 100 is designed to destroy the flammable gas by the mean of controlled combustion processes with an efficiency of more than 99%. Thus, on average, more than 99% of the flammable gas supplied to the gas flare system 100 can be oxidized through combustion in the gas flare system 100. In most implementations, the flue gas temperature leaving the flare stack chamber 112 at the opened top end 116 will be at least 760° C. and the minimum retention time of the flue gas in the flare stack chamber 112 will be of at least 0.30 second, as required by current standards. Other values are possible as well. For instance, the flue gas temperature leaving the flare stack chamber 112 can reach about 900° C. or more.

The gas flare system 100 can also automatically start when required and operate efficiently without any supervision, even with a downtime ratio of about 99% or more on an annual basis. In other words, the gas flare system 100 can remain on standby for a very long period of time and still be ready for an operation at full capacity whenever required.

As shown in FIG. 1, the gas flare system 100 includes a flare stack 110. The flare stack 110 defines a flare stack chamber 112 extending vertically between a bottom floor wall 114 and an opened top end 116 of the flare stack 110. In the illustrated example, the outer wall 118 of the flare stack 110 is substantially cylindrical in shape. The interior of the outer wall 118 has a substantially circular inner cross section and a relatively uniform inner diameter along its height. The bottom floor wall 114 can be welded or otherwise attached to the bottom of the outer wall 118. Variants are possible as well. For instance, the flare stack chamber 112 can have a non-circular cross section in some implementations. The outer wall 118 of the flare stack 110 can also be non-circular on the outside. Many other variants are possible.

The flare stack chamber 112 provided inside the flare stack 110 is designed to be relatively compact, depending on the implementation. This is made possible, among other things, by minimizing the flame height. The flare stack 110 of the proposed concept also has no air intake by which air for the combustion is simply drafted through naturally-induced aspiration. Air for the combustion of the flammable gas is rather supplied through a forced air source or sources.

The flare stack 110 and the bottom floor wall 114 can be made of metal, for instance. The upper side of the bottom floor wall 114 and the interior of the outer wall 118 can be insulated with a high-temperature resistant material, for instance a refractory concrete coating the metallic surfaces. Variants are possible as well.

The gas flare system 100 is designed to be installed and used outdoors. It includes a weatherproof protective hood arrangement 120. The hood arrangement 120 includes an overhead cap 122 located vertically above the opened top end 116 of the flare stack 110. In the illustrated example, the overhead cap 122 is lozenge shaped and has a circular side edge. The cap 122 is centered with reference with the opened top end 116 and has a diameter larger than that of the opened top end 116. It thus covers more than the entire area of the opened top end 116 and therefore, the flare stack chamber 112 will not be directly visible from above the flare stack 110. This will prevent falling rain water and snow from easily entering into the flare stack chamber 112, regardless of whether the gas flare system 100 is in operation or not. Other kinds of debris are also prevented from easily entering the flare stack chamber 112. The shape of the upper surface of the illustrated cap 122 prevents water from accumulating thereon. The cap 122 includes a peripheral drip ring 124 on its side edge to facilitate drainage of rain water and melted snow from the upper surface thereof. The shape of the bottom surface of the illustrated cap 122 also promotes flue gas circulation from the flare stack chamber 112 to the outside. Other configurations and shapes are also possible as well.

The hood arrangement 120 further includes a lateral peripheral shroud 126 surrounding the opened top end 116 of the flare stack 110 and also the overhead cap 122. The shroud 126 mitigates the risks of having rain water and snow being pushed by cross winds into the flare stack 110. The illustrated shroud 126 is generally circular and is coaxially disposed with reference to the opened top end 116, thus with reference to the flare stack 110. It also has an inverted funnel-shaped top portion with a diameter larger than the diameter of the bottom portion. At its bottom portion, the diameter is constant from substantially below the edge of the opened top end 116 of the flare stack 110. The junction between the upper portion and the bottom portion is approximately at the height of the opened top end 116.

The hood arrangement 120 provides an annular flue gas outlet circuit 130 extending from the top of the flare stack chamber 112, through the generally annular space between the open top end 116 and the cap 122, and then through to the annular space between the interior of the shroud 126 and the cap 122. The bottom annular space between the bottom portion of the shroud 126 and the exterior surface of the outer wall 118 near the open top end 116 provides a passageway for water dripping from the peripheral drip ring 124. This water can then easily fall by gravity towards the base of the gas flare system 100. Variants are possible as well.

It should be noted that the hood arrangement 120 includes brackets and/or other supports for attaching the cap 122 and the shroud 126 on the outer wall 118 of the flare stack 110. These are not shown in the illustrated example for the sake of clarity. Other configurations are also possible.

The gas flare system 100 includes a plenum housing 140 located directly underneath the bottom floor wall 114 of the flare stack 110. The space inside the plenum housing 140 is designed to be pressurized, as will be described later in the text. The plenum housing 140 has no direct air intake from the outside.

The illustrated plenum housing 140 includes a cylindrical outer wall 142 having the same diameter as the outer wall 118 of the flare stack 110. It also includes a bottom floor wall 144. The upper side of the plenum housing 140 is closed by the bottom floor wall 114 of the flare stack 110. Variants are possible as well. For instance, the outer wall 142 can be a bottom portion of the outer wall 118 extending below the bottom floor wall 114. Alternatively, the plenum housing 140 can have a different diameter and/or a different shape than that of the flare stack 110. Many other variants are possible as well.

Figure 3:
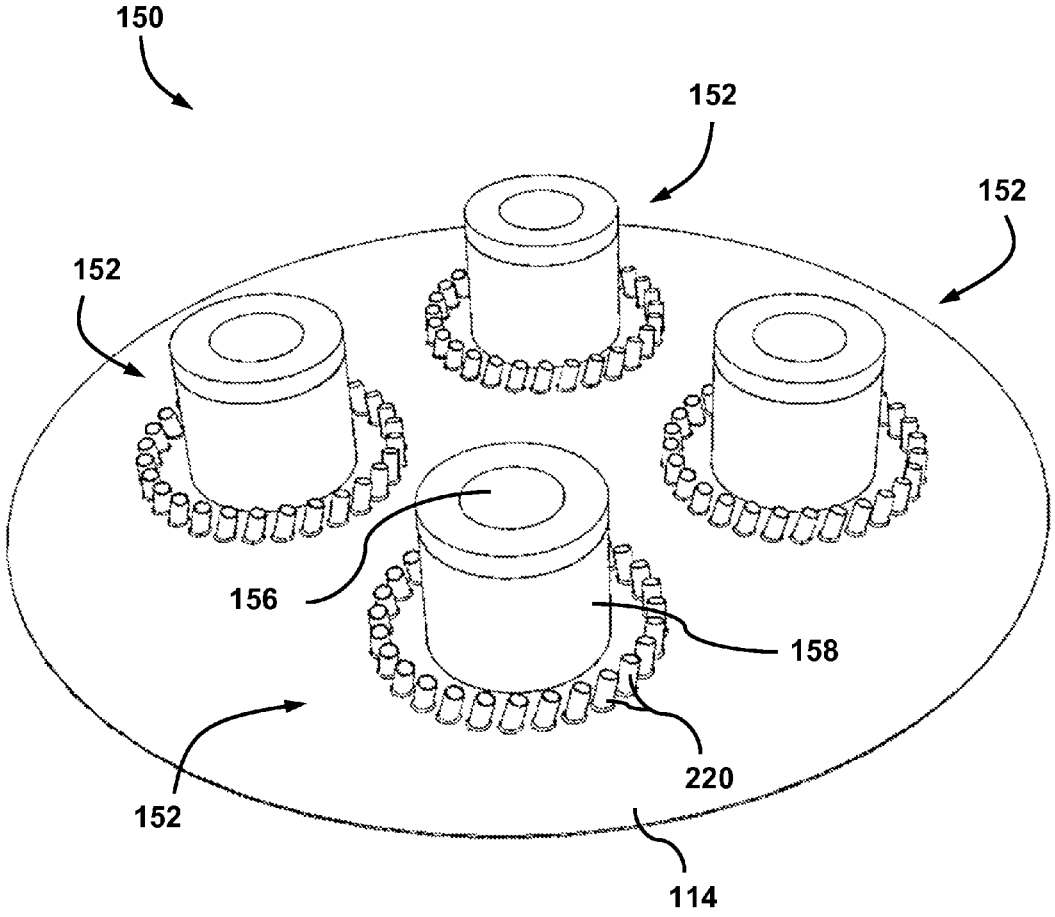
FIG. 3 is an isometric view illustrating the burner arrangement of the gas flare system shown in FIG. 1.
Figure 4:
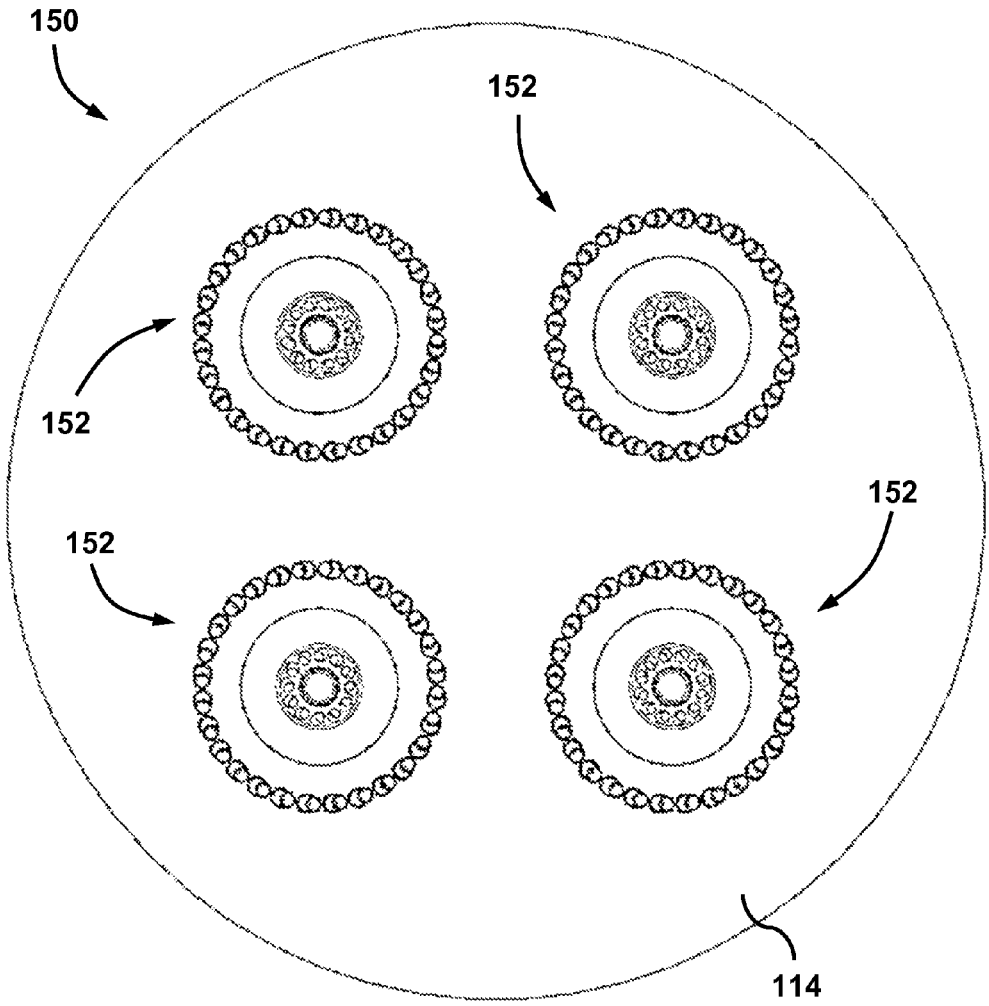
FIG. 4 is a top view of the burner arrangement shown in FIG. 3.

The gas flare system 100 includes a burner arrangement 150 provided through the bottom floor wall 114 of the flare stack 110. The burner arrangement 150 of the illustrated example has four burner outlets 152, as best shown in FIGS. 3 and 4. Only two burner outlets 152 are visible in FIG. 1 since this view is a cross section.

Depending on the implementation, the burner arrangement 150 can also include one, two, three or more than four burner outlets 152. Each burner outlet 152 can be defined as a location where a flame can be created when the flammable gas is destroyed during the operation of the gas flare system 100. If more than one burner outlet 152 is provided, the burner outlets 152 are spaced apart from one another and be disposed in an axisymmetric manner on the bottom floor wall 114. Variants are possible. Each burner outlet 152 can have either the same capacity or at least some of them may have a different capacity. More details on this aspect of the proposed concept will be given later.

Each burner outlet 152 is configured and disposed to have the flame substantially upright with reference to the vertical axis when the gas flare system 100 is in operation. A bottom portion of each burner outlet 152 extends under the bottom floor wall 114 and each burner outlet 152 also has an upper portion extending above the bottom floor wall 114. In the illustrated example, the burner outlets 152 are made integral with the bottom floor wall 114. More particularly, the burner outlets 152 are constructed directly on both sides of the bottom floor wall 114, for instance using metal parts welded or otherwise connected thereon, before the protective layer is provided thereon. Variants are possible as well.

Figure 2:
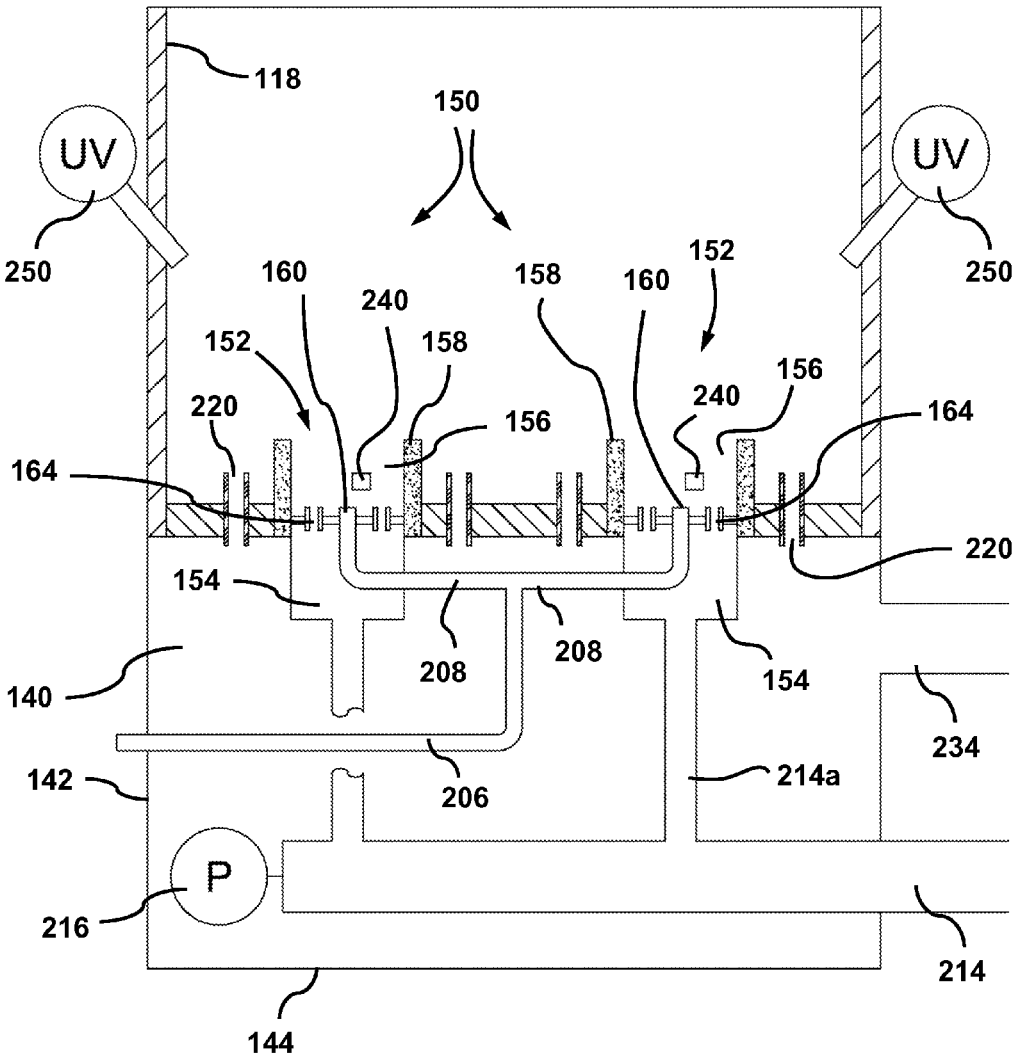
FIG. 2 is an enlarged view of the bottom of the gas flare system shown in FIG. 1.

As best shown in FIG. 2, the bottom portion of each burner outlet 152 includes a corresponding primary air housing 154 extending under the bottom floor wall 114 and into the plenum housing 140. The upper portion of each burner outlet 152 includes a corresponding top-opened combustion chamber 156 located directly above the primary air housing 154. Each combustion chamber 156 is surrounded by a cylindrical wall 158. This cylindrical wall 158 can be coated with a heat protective layer to withstand the intense heat generated during operation of the gas flare system 100, as best shown in FIG. 3. Variants are possible as well.

In operation, the waste gas stream is supplied to each burner outlet 152 and exits through a corresponding waste gas outlet 160 provided through the bottom of the combustion chamber 156, more particularly at the center of the corresponding burner outlet 152. The waste gas outlet 160 is shown in greater details in FIG. 5. It includes a plurality of axisymmetric orifices 160 that are provided through a disk plate 162 in the illustrated example. The waste gas is ejected out of the waste gas outlet orifices 160 in a substantial vertical upward direction in the illustrated example. Variants are possible as well.

Figure 5:
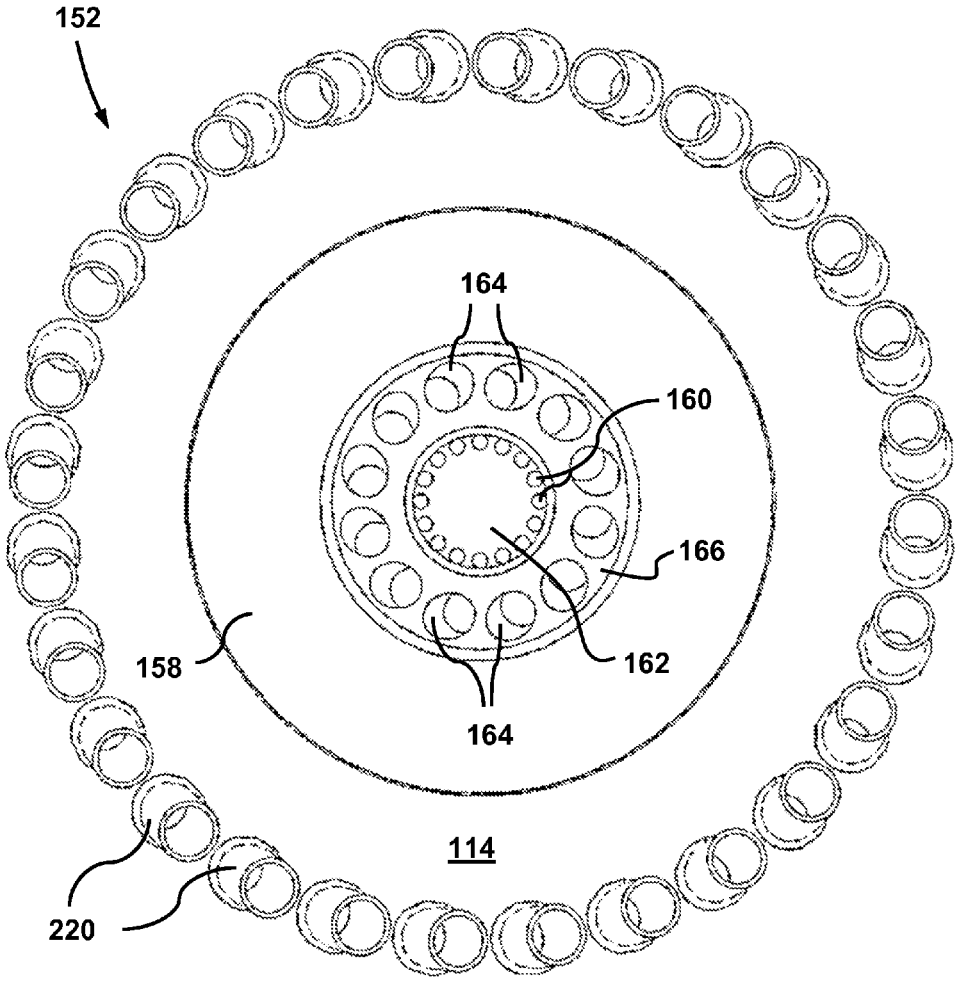
FIG. 5 is a close-up view of one of the burner outlets shown in FIG. 4.

Also, in operation, primary air is received under pressure inside the primary air housing 154 of each burner outlet 152. The primary air then enters the combustion chamber 156 through a primary air outlet 164 that is provided between the primary air housing 154 and the bottom of the combustion chamber 156, more particularly through an annular plate 166 positioned around the disk plate 162 in the illustrated example, as shown in FIG. 5. The primary air orifices 164 are configured and disposed to surround the waste gas outlet orifices 160 in an axisymmetric manner. The diameter and/or shape of the primary air orifices 164 are designed so as to output the desired amount of primary air by varying the pressure inside the primary air housing 154. The primary air orifices 164 are calibrated to obtain a direct correlation between the primary air pressure and the flow rate. Still, the primary air orifices 164 can be obliquely disposed to induce a clockwise or counterclockwise swirling motion of the combustion gases in the combustion chamber 156 as shown. In the illustrated example, the primary air orifices 164 are obliquely oriented to create a clockwise motion when viewed from above. The primary air jets from each primary air orifices 164 are substantially tangential with reference to the waste gas stream coming out vertically from the waste gas outlet orifices 160. The primary air jets are not intersecting one another during operation of the gas flare system 100. Variants are possible as well.

It should be noted that the gas flare system 100 is designed so that the waste gas stream and the primary air circuit only merge together to form a combustible mixture once inside the combustion chamber 156. No premix is being made upstream of the combustion chamber 156. This improves the control over the flame pattern in the combustion zone during operation. Also, the swirling effect creates turbulences promoting an efficient combustion of the flammable gas using the oxygen contained in the air being supplied. The combustion of the flammable gas forms hot combustion gases.

Also present are the non-flammable gases from the waste gas stream (for instance carbon dioxide) and the other gases present in the air (for instance nitrogen), all of which will be mixed with the combustion gases. These gases will rise inside the flare stack chamber 112 and form the hot flue gas flowing out of the flare stack 110 through the flue gas outlet circuit 130.

It should be noted that the waste gas stream may already include some oxygen. This oxygen, however, is not enough to obtain a complete combustion of the flammable gas. Makeup air must thus be always supplied for the destruction of the flammable gas in the waste gas stream.

The waste gas stream containing the flammable gas to be destroyed is supplied to under pressure in the gas flare system 100 through a waste gas inlet pipe 170, as shown in FIG. 1. Depending on the implementation, the gas flare system 100 can be designed to automatically start in response to the waste gas inlet pipe 170 being pressurized, i.e. the pressure inside the waste gas inlet pipe 170 rising above a given threshold pressure. The operation of the gas flare system 100 can also stop automatically when the pressure inside the waste gas inlet pipe 170 falls below a given threshold pressure. Alternatively, or in addition, the gas flare system 100 can be designed to automatically start in response to a process command originating from an automated control system or a manual control system at the waste-to-energy project. Other variants are possible as well.

The waste gas stream coming into the gas flare system 100 through the inlet of the waste gas inlet pipe 170 will be ultimately conveyed to the burner outlets 152 through a waste gas circuit. The waste gas circuit is in fluid communication with the combustion chambers 156 of the burner outlets 152. It includes a network of pipes, conduits and other components. The waste gas inlet pipe 170 is itself part of the waste gas circuit.

The gas flare system 100 is generally designed so as to have a capacity sufficient to process the maximum amount of the waste gas stream that can be sent to it. However, the amount of the waste gas stream to be destroyed will often be well below the maximum capacity of the gas flare system 100. For instance, when the gas flare system 100 is installed next to a waste-to-energy project, it may happen that only a small amount of the total waste gas stream coming from the waste gas source cannot be processed by the waste-to-energy project and therefore, must be destroyed in the gas flare system 100. The waste gas stream can generally be from about 2.5% to 100% of the maximum amount of the waste gas stream it can handle. The flammable gas fraction in the waste gas stream can also vary over time. Also, the gas flare system 100 is often designed so as to have no direct control on the flow of waste gas it receives. Monitoring the flow rate, the pressure and the flammable gas composition in the waste gas stream received at the waste gas inlet pipe 170 provides the gas flare system 100 with information for adjusting the flow of primary air and optionally other operating parameters.

In the example illustrated in FIG. 1, the waste gas stream received at the gas flare system 100 is continuously monitored by various sensing devices, such as a flow meter 180, a pressure sensor 182 and a waste gas composition analyzer 184. The flow meter 180 and the pressure sensor 182 are mounted directly on the waste gas inlet pipe 170 in this example. The waste gas composition analyzer 184 is made in fluid communication with the waste gas inlet pipe 170 through a sample pipe conduit 186, as shown. The waste gas composition analyzer 184 can be for instance a gas chromatograph and monitors the flammable gas fraction. Other gases can also be monitored. Still, other kinds of waste gas composition analyzers and other kinds of sensing devices are possible. Many other variants are also possible as well.

Data obtained from the flow meter 180 and the pressure sensor 182 during operation of the gas flare system 100 allow calculating a standardized flow rate of the waste gas stream in the waste gas inlet pipe 170. The flow rate is said to be "standardized" since it can be indirectly obtained from an equation or a lookup table with data from the flow meter 180 and the pressure sensor 182. The waste gas composition analyzer 184 will provide data indicative of the flammable gas fraction in the waste gas stream, for instance the methane gas fraction. The standardized flow rate of the waste gas stream and the flammable gas fraction therein are indicative of the flammable gas content in the waste gas inlet pipe 170. Using this data, a first controller 300 provided in the gas flare system 100 will automatically manage the operation other components, including the flow of primary air.

As can be seen in FIG. 1, the waste gas inlet pipe 170 is connected to two different gas supply systems, namely a pilot gas supply that includes a pilot gas train system 190 and a first actuated control valve 194, and a burner main gas supply that includes a burner gas train system 200 and a second actuated control valve 204. Variants are possible as well.

The pilot gas train system 190 and the burner gas train system 200 are basically safety shutoff valves provided as additional safeguard devices. These devices are standard and regulated units required for complying with safety standards set by authorities such as approval agencies. The pilot gas train system 190 and the burner gas train system 200 are controlled by an independent burner management system (BMS) 320 receiving data signals from other components. The BMS 320 also controls an ignition device 240 for igniting the pilot flame. It should be noted, however, that the design of the gas train systems 190, 200 and the design of the BMS 320 form no direct part of the proposed concept.

In the illustrated example, a first manual shutoff valve 192, the pilot gas train system 190 and the first actuated control valve 194 are mounted on a first pipe 196 connected to pipe 206 on which a second manual shutoff valve 202, the burner gas train system 200 and the second actuated control valve 204 are mounted. The first and second actuated valves 194, 204 are controlled by the first controller 300 in the illustrated example. Variants are also possible.

The downstream end of pipe 206 is in fluid communication with waste gas outlet orifices 160 through side pipes 208, as shown in FIG. 2. Variants are possible as well.

The primary air housing 154 of each burner outlet 152 receives the primary air under pressure from a primary air circuit. The primary air circuit includes one or more ducts and other components provided to convey primary air coming from a primary air fan 210 up to the primary air housings 154 of the burner outlets 152. The primary air fan 210 is schematically illustrated in FIG. 1. In the illustrated example, the primary air circuit provides from 50 to 100% of the air required for the stoichiometric combustion process of the flammable gas content, as monitored and controlled by the first controller 300. Variants are possible as well.

The primary air fan 210 can be located near the flare stack 110 or elsewhere in or around the base of the flare stack 110. The flow rate of the primary air fan 210 can be controlled using a primary air circuit flow regulator 212, for instance a primary air damper provided on a primary air duct 214. Other kinds of primary air circuit flow regulators can be used, for instance a motor speed controller for the motor of the primary air fan 210. The primary air duct 214 extends between the primary air fan 210 and the primary air housings 154 of the burner outlets 152. The air pressure inside the primary air duct 214 is monitored using a pressure sensor 216 located downstream the primary air circuit flow regulator 212 of the illustrated example. Other variants are possible.

The primary air duct 214 of the illustrated example includes a main horizontal section from which smaller vertical sections 214*a* extend to reach the primary air housing 154 of each burner outlet 152, as shown in FIGS. 1 and 2. Variants are also possible.

To complete the combustion of the flammable gas and to reduce the flue gas temperature in operation, the gas flare system 100 also includes a secondary air circuit in which secondary air is supplied under pressure into the plenum housing 140. In the illustrated example, the plenum housing 140 is in fluid communication with the flare stack chamber 112 through a plurality of calibrated secondary air orifices 220 extending through the bottom floor wall 114. These secondary air orifices 220 include tubes extending above and across the bottom floor wall 114 as well as its layer of refractory concrete, as shown. Variants are possible In operation, the pressurization of the plenum housing 140 enables the secondary air to flow into the flare stack chamber 112 through the secondary air orifices 220. These secondary air orifices 220 can be obliquely disposed to induce a clockwise or counterclockwise gas swirling motion that is opposite the swirling direction created using the primary air. The secondary air completes the combustion of the flammable gas and also lowers the flue gas temperature coming out through the flue gas outlet circuit 130. Other arrangements are possible.

In the illustrated example, the secondary air is supplied using a secondary air fan 230 located near the flare stack 110 or elsewhere in or around the base of the flare stack 110. The flow rate of the secondary air fan 230 can be controlled using a secondary air circuit flow regulator 232. The secondary air circuit flow regulator 232 is an actuated secondary air damper provided on a secondary air duct 234 in the illustrated example. The secondary air duct 234 extends between the secondary air fan 230 and the plenum housing 140. Variants are also possible. For instance, the secondary air circuit flow regulator could be or include a controller for the motor of the secondary air fan 230. Other variants are possible as well.

The air flow rate of the secondary air circuit can generally be adjusted from 50 to 150% of the stoichiometric combustion air requirements. Other values are possible and other arrangements and configurations are also possible.

In operation, the secondary air reduces the volume of primary air to be supplied by the primary air circuit into the combustion chamber 156 of each burner outlet 152. Providing less than 100% of the stoichiometric air and mixing it with the flammable gas only in the combustion chamber 156 of each burner outlet 152 decreases the velocity of the combustion gases and mitigates the risks of a flame-out when the gas flare system 100 is operating at a low regime.

The gas swirling motion induced by the primary air orifices 164 in the combustion chamber 156 and the gas swirling motion induced by the secondary air orifices 220 in the opposite direction within the flare stack chamber 112 also promote the complete destruction of the flammable gas and the creation of a very compact flame pattern. Tests conducted using the proposed concept resulted in substantially cordiform flame patterns above the burner outlets 152. Overall, combining both the primary air circuit and the secondary air circuit as described herein can greatly improve the efficiency of the flammable gas destruction without generating excessive nitrous oxides (NOx). NOx can be minimized with the gas flare system 100, for instance maintained below 20 $mg/m^3$.

The illustrated gas flare system 100 can include a flame scanner 250 for each burner outlet 152. The flame scanners 250 can be for instance UV detectors. They can be mounted on or inside the interior of the outer wall 118 of the flare stack 110. The flame scanners 250 are positioned and disposed so as to detect the flame generated by the pilot flame and also by the combustion of the flammable gas in the burner outlets 152. The flame scanners 250 can also be attached elsewhere inside the flare stack chamber 112. Variants are possible as well.

In the illustrated example, a temperature sensor 260 is mounted inside the flare stack 110 to monitor the temperature of the hot flue gases rising inside the flare stack chamber 112. Data indicative of the temperature of the flue gases are sent to a second controller 310, which can then adjust the flow rate of the secondary air, if necessary, using the secondary air circuit flow regulator 232. The on-off activation of the motor of the secondary air fan 230 is also controlled by the second controller 310. Variants are possible as well.

Also in the illustrated example, small amounts of the flue gases are collected through a perforated sampling pipe 270 located near the opened top end 116 of the flare stack 110. This perforated sampling pipe 270 is horizontally disposed as shown. It extends across the interior of the outer wall 118 of the flare stack 110. The perforations of the perforated sampling pipe 270 are oriented towards the bottom floor wall 114. In use, the flue gases generated in the illustrated flare stack chamber 112 are sampled and analyzed, using for instance the same waste gas composition analyzer 184 that analyzes the waste gas stream at the inlet. The sample pipe 270 and the waste gas composition analyzer 184 can be connected together using a corresponding sampling pipe conduit 272, as shown. The flue gases can also be analyzed with a different composition analyzer if needed. Other variants are possible. The flue gas composition is analyzed to detect amounts of unburned flammable gas. If detected, this would indicate to the first controller 300 that the destruction is incomplete and that the primary air flow rate must be adjusted.

Figure 6:
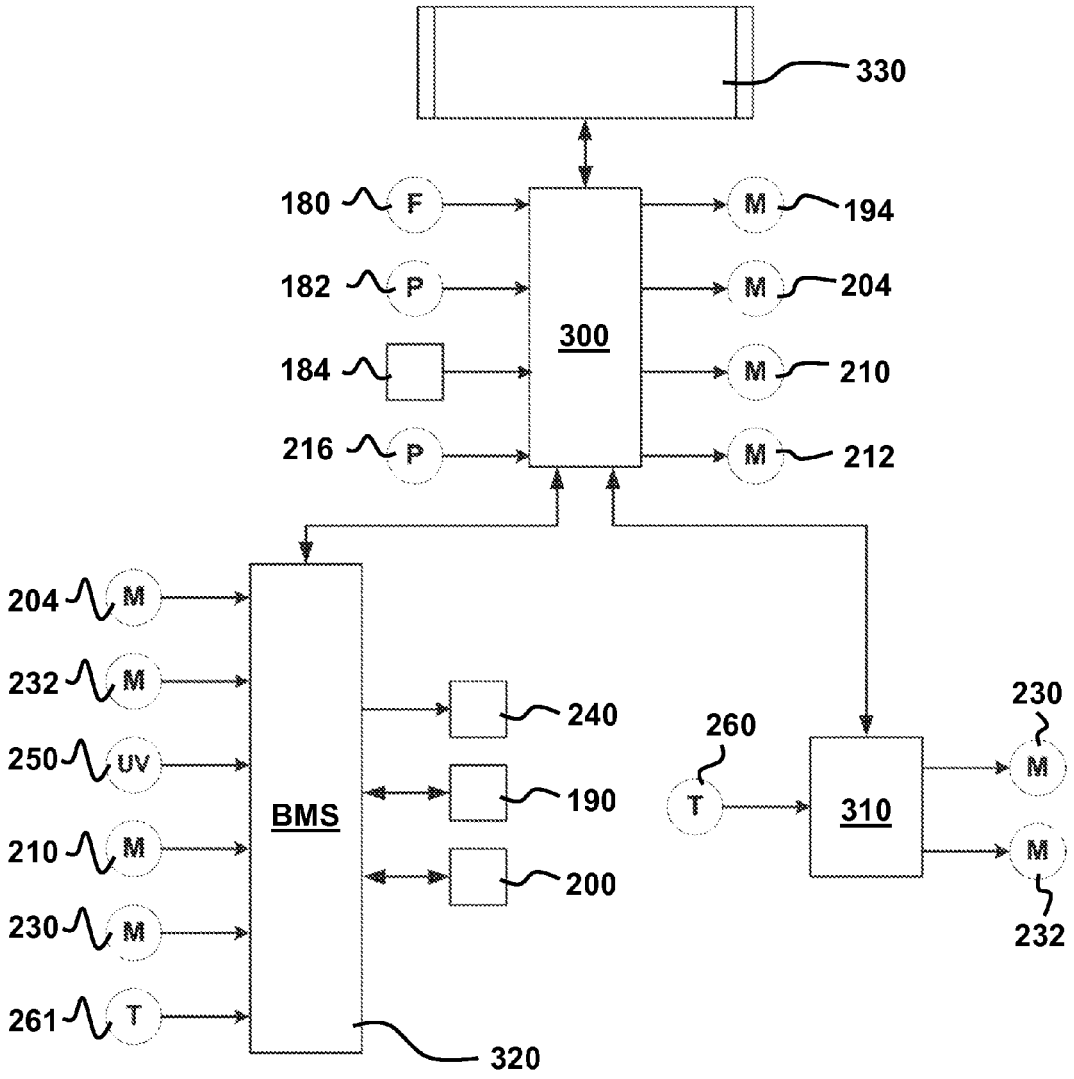
FIG. 6 is a block diagram depicting an example of the control arrangement of the gas flare system.

FIG. 6 is a block diagram depicting an example of the control arrangement 302 of the gas flare system 100. FIG. 6 also shows that the illustrated control arrangement 302 includes the first controller 300, the second controller 310 and the burner management system (BMS) 320. The BMS 320 receives data signals from the flame scanners 250 and also from another temperature sensor 261 located in the flare stack chamber 112 near the opened top end 116. The regulation valve 204, the primary air fan 210, the secondary air fan 230 and the secondary air circuit flow regulator 232 provide feedback signals to the BMS 320 that are indicative of their operation. Signals are also exchanged between the BMS 320 and the gas train systems 190, 200. The BMS 320 controls the ignition system 240. Variants are possible as well.

The first controller 300 and the second controller 310 can be programmed into one or more general purpose computers, dedicated printed circuit boards and/or other suitable devices otherwise configured to achieve the desired functions of receiving the data and sending command signals. Depending on the implementation, the first controller 300 and the second controller 310 can be integrated into a single device. Each controller 300, 310 would then be, for instance, a portion of the software code loaded into the device.

A control/display interface 330 is provided to access the control arrangement 302, as schematically shown in FIG. 6.

In the illustrated example, the first controller 300 is designed to send command signals to control the regulation valves 194 and 204, the starting of the motor of the primary air fan 210 and the primary air circuit flow regulator 212 in response at least to data signals received from the waste gas flow meter 180, the waste gas pressure sensor 182, the primary air pressure sensor 216 and the waste gas composition analyzer 184. The second controller 310 is designed to send command signals to the control the starting of the motor of the secondary air fan 230 and the secondary air circuit flow regulator 232 in response at least to data signals received from at least the flue gas temperature sensor 260. Variants are possible as well.

The flow rate of secondary air in the secondary air circuit is initially set to a basic flow rate during ignition and warm up. It will be adjusted during normal operation based on the flue gas temperature. If the flue gas temperature rises, the flow rate of the secondary air circuit will be increases. If the flue gas temperature decreases, the flow rate of the secondary air circuit will be decreased.

The gas flare system 100 can be subjected from time to time to a purge procedure after a given downtime period. This involves simultaneous purging the combustion chambers 156 with primary air and purging the flare stack chamber 112 with secondary air. Both the air fans 210, 230 can be operating at full speed and the positions of the air circuit flow regulators 212, 232 can be set to a fully opened position. This purge can be repeated on a regular basis, for instance, every 40 hours, in order to remove dust and humidity inside the gas flare system 100. Running the air fans 210, 230 also helps maintaining the gas flare system 100 in good working condition. If desired, a schedule can be provided, for instance at the waste-to-energy project, to run the gas flare system 100 for a short period of time if it was in a standby mode for a prolonged time period. For instance, after a week of being in a standby mode, the gas flare system 100 can be put into full operation for about an hour. This procedure is optional and many variants are also possible.

When switching from a standby mode to a mode where the gas flare system 100 is in operation, the flammable gas in the waste gas inlet pipe 170 is first monitored with the gas composition analyzer 184 to establish the flammable gas fraction. At the same time, the waste gas flow rate is set according to the predetermined ignition flow rate with the regulation valve 194. The primary air supplied through the calibrated primary air orifices 164 is then set to match the requirements for creating a pilot flame. The secondary air supplied through the calibrated secondary air orifices 220 is initially set to a predetermined ignition flow rate using the secondary air circuit flow regulator 232. When the flammable gas content and the flow rates of the calibrated ports are confirmed, the ignition device 240 lights the flammable gas in the combustion chamber 156 to create the pilot flame in each burner outlet 152. The ignition device 240 can include for instance a spark plug. Variants are possible as well.

Once the presence of the pilot flame confirmed, for instance using the flame scanners 250, the first controller 300 lets the rest of the waste gas stream in by opening the regulation valve 204 to a wide-opened position. The flow rate of primary air into the primary air circuit is also adjusted in response to the flow rate of the waste gas stream received from the waste-to-energy project through the waste gas inlet pipe 170. The gas flare system 100 is not controlling the flow rate at this point and is designed to process the entire amount of the waste gas being sent to it. During this operation, the supplied waste gas stream is continuously monitored by the waste gas flow meter 180, the waste gas pressure sensor 182 and the waste gas composition analyzer 184. Based on data from these devices, the flow rate of primary air required for the combustion of the flammable gas in the combustion chambers 156 is adjusted by the first controller 300 to obtain optimum conditions for the destruction of the flammable gas.

The flue gas temperature in the flare stack chamber 112 is the main factor controlling the flow rate of the secondary air in the illustrated example. During operation, the temperature of the flue gases in the flare stack chamber 112 is continuously monitored using the flue gas temperature sensor 260. The secondary air supplied by the secondary air fan 230 is then adjusted according to the desired temperature objective using the secondary air circuit flow regulator 232. If the flue gas temperature is too high, the secondary air circuit flow regulator 232 will provide more secondary air and if the flue gas temperature in the flare stack chamber 112 is too low, the secondary air circuit flow regulator 232 will provide less secondary air. This flow rate adjustment can be done on a real time basis during operation of the gas flare system 100. Variants are possible as well.

If desired and as aforesaid, one or more of the burner outlets 152 can have a different capacity. For instance, one burner outlet 152 can be smaller than another. The waste gas circuit can then include one or more valve arrangements allowing the first controller 300 to select which one of the burner outlets 152 will operate. If the quantity of waste gas is relatively small, only the smaller burner outlet(s) 152 can be used. Nevertheless, even if all burner outlets 152 have the same capacity, using a valve arrangement to select which one or ones are needed will considerable increase the turndown ratio of the gas flare system 100.

The gas flare system 100 can be designed to have a turndown ratio of 40:1. Using various configurations, this turndown ratio can be higher and even reach up to 400:1, if not higher.

As it can be appreciated, the proposed concept will result in a gas flare system 100 having a complete but flexible construction, all of which is integrated into a single unit that can be operated under almost any weather conditions and remain in a standby mode for extensive period of time. The gas flare system 100 can be installed at sites having a wide range of weather conditions, for instance where the temperatures can vary from −40° C. to +40° C.

The present detailed description and the appended figures are meant to be exemplary only. A skilled person will recognize that variants can be made in light of a review of the present disclosure without departing from the proposed concept.

REFERENCE NUMERALS

100 gas flare system
110 flare stack
112 flare stack chamber
114 bottom floor wall
116 opened top end
118 outer wall
120 weatherproof protective hood arrangement
122 overhead cap
124 drip ring
126 lateral peripheral shroud
130 flue gas outlet circuit
140 plenum housing
142 outer wall (of plenum housing)
144 bottom floor wall (of plenum housing)
150 burner arrangement
152 burner outlet
154 primary air housing
156 combustion chamber
158 cylindrical wall
160 waste gas outlet orifices
162 disk plate
164 primary air orifices
166 annular plate
170 waste gas inlet pipe
180 flow meter
182 pressure sensor
184 gas composition analyzer
186 sampling pipe conduit
190 pilot gas train system
192 shutoff valve
194 actuated regulation valve
196 pipe
200 burner gas train system
202 shutoff valves
204 actuated regulation valve
206 pipe
208 side pipes
210 primary air fan
212 primary air circuit flow regulator
214 primary air duct
214*a* vertical sections
216 pressure sensor
220 secondary air orifices
230 secondary air fan
232 secondary air circuit flow regulator
234 secondary air duct
240 ignition device
250 flame scanners
260 temperature sensor
261 temperature sensor
270 perforated sampling pipe
272 sampling pipe conduit
300 first controller
302 control arrangement
310 second controller
320 burner management system (BMS)
330 control/display interface

What is claimed is:

1. A gas flare system for destroying a flammable gas contained in a waste gas stream, the gas flare system including:

a flare stack defining a flare stack chamber extending vertically between a bottom floor wall and an opened top end of the flare stack;

a weatherproof protective hood arrangement including an overhead cap located vertically above the opened top end and covering more than an entire area of the opened top end, and a lateral peripheral shroud surrounding the opened top end and the overhead cap;

a plenum housing located directly underneath the bottom floor wall;

a burner arrangement provided through the bottom floor wall, the burner arrangement having at least one burner outlet including:

a top-opened combustion chamber extending above the bottom floor wall;

a primary air housing extending under the bottom floor wall and into the plenum housing;

a waste gas outlet located at a bottom of the combustion chamber; and a primary air outlet extending between the primary air housing and the bottom of the combustion chamber, the primary air outlet being adjacent to the waste gas outlet;

a waste gas circuit in fluid communication with the waste gas outlet of the at least one burner outlet;

a primary pressurized air circuit in fluid communication with the primary air housing of the at least one burner outlet, the primary air circuit including a primary air circuit flow regulator;

a primary air pressure sensor provided on the primary air circuit;

a secondary pressurized air circuit in fluid communication with the flare stack chamber, the secondary air circuit passing inside the plenum housing and ending at a plurality of secondary air orifices provided through the bottom floor wall around the at least one burner outlet, the secondary air circuit including a secondary air circuit flow regulator;

a waste gas composition analyzer in fluid communication with the waste gas inlet pipe;

a waste gas pressure sensor provided on the waste gas inlet pipe;

a waste gas flow meter provided on the waste gas inlet pipe;

a flue gas composition analyzer in fluid communication with a location adjacent to the opened top end inside the flare stack chamber;

a flue gas temperature sensor located in the flare stack chamber and adjacent to the opened top end;

a first controller sending command signals to control at least the primary air circuit flow regulator in response to data signals received from the waste gas pressure sensor, the waste gas flow meter, the waste gas composition analyzer, the flue gas composition analyzer and the primary air pressure sensor; and a second controller sending command signals to control at least the secondary air circuit flow regulator in response to data signals received from the flue gas temperature sensor.

2. The gas flare system as defined in claim 1, wherein the burner arrangement includes more than one burner outlet, the burner outlets being spaced apart from one another and each burner outlet being surrounded by a corresponding set of the secondary air orifices.

3. The gas flare system as defined in claim 2, wherein the secondary air orifices of each set are axisymmetric with reference to each burner outlet.

4. The gas flare system as defined in claim 1, wherein the primary air outlet includes a plurality of axisymmetric primary air orifices surrounding the waste gas outlet.

5. The gas flare system as defined in claim 4, wherein the primary air orifices are obliquely disposed to promote a first swirling gas motion in the combustion chamber of the at least one burner outlet.

6. The gas flare system as defined in claim 5, wherein the secondary air orifices are obliquely disposed to promote a second swirling gas motion above the combustion chamber of the at least one burner outlet, the second swirling gas motion being in an opposite direction than that of the first swirling gas motion.

7. The gas flare system as defined in claim 1, wherein the primary air circuit includes a primary air fan and a primary air duct, the primary air duct being provided between the primary air fan and the primary air housing of the at least one burner outlet.

8. The gas flare system as defined in claim 7, wherein the primary air circuit flow regulator includes an actuated primary air damper provided on the primary air duct.

9. The gas flare system as defined in claim 1, further including an ignition device to ignite the flammable gas coming into the combustion chamber of the at least one burner outlet.

10. The gas flare system as defined in claim 1, wherein the secondary air circuit includes a secondary air fan and a secondary air duct, the secondary air duct being provided between the secondary air fan and the plenum housing.

11. The gas flare system as defined in claim 10, wherein the secondary air circuit flow regulator includes an actuated secondary air damper provided on the secondary air duct.

12. The gas flare system as defined in claim 1, further including a flue gas sampling pipe located in the flare stack chamber and adjacent to the opened top end, the flue gas sampling pipe being in fluid communication with the flue gas composition analyzer.

13. The gas flare system as defined in claim 12, wherein the waste gas composition analyzer and the flue gas composition analyzer are the same device.

14. The gas flare system as defined in claim 1, further including a flame scanner located in the flare stack chamber between the bottom floor wall and the opened top end.

15. The gas flare system as defined in claim 1, wherein the flare stack includes an outer wall having a substantially circular inner cross section.

16. The gas flare system as defined in claim 1, wherein the burner arrangement has a turndown ratio of at least 40:1.

17. The gas flare system as defined in claim 1, wherein the burner arrangement has a turndown ratio of at least 400:1.

18. A method of destroying a flammable gas in flare system, the method including:

continuously preventing rain water and snow from entering through an opened top end of the flare system;

monitoring pressure, flow rate and flammable gas fraction of the waste gas stream received at the flare system;

supplying the waste gas stream to a burner arrangement provided inside the flare system; and burning off the flammable gas by:

supplying pressurized primary air inside the burner arrangement, the primary air and the waste gas stream only mixing inside a combustion chamber of the burner arrangement;

supplying pressurized secondary air from underneath the burner arrangement;

ejecting the secondary air around the combustion chamber of the burner arrangement;

monitoring temperature and flammable gas fraction of the flue gas resulting from burning off the flammable gas;

controlling the primary air supplied to the burner arrangement in function of the flammable gas fraction in the waste gas stream, the waste gas stream pressure, the waste gas stream flow rate and the flammable gas fraction in the flue gas; and controlling the secondary air in function of the flue gas temperature.

19. The method as defined in claim 18, wherein the steps of monitoring the flammable gas fraction of the waste gas stream, supplying the waste gas stream to the burner arrangement and burning off the flammable gas are automatically initiated even after a prolonged standby period.

20. The method as defined in claim 19, wherein the steps are automatically initiated upon receiving the waste gas stream at a waste gas inlet pipe above a threshold pressure detected by the waste gas pressure sensor.

21. The method as defined in claim 18, wherein the step of burning off the flammable gas includes creating a flame having a substantially cordiform pattern.

* * * * *